US006220340B1

(12) United States Patent
Cheong et al.

(10) Patent No.: US 6,220,340 B1
(45) Date of Patent: Apr. 24, 2001

(54) HEAT EXCHANGER WITH DIMPLED BYPASS CHANNEL

(75) Inventors: Alex S. Cheong, Mississauga (CA); Yong N. Lee, Mount Prospect, IL (US)

(73) Assignee: Long Manufacturing Ltd., Oakville (CA)

( * ) Notice: Subject to any disclaimer, the term of this patent is extended or adjusted under 35 U.S.C. 154(b) by 0 days.

(21) Appl. No.: 09/515,193

(22) Filed: Feb. 29, 2000

(30) Foreign Application Priority Data

May 28, 1999 (CA) ..... 2272804

(51) Int. Cl.[7] ..... F28F 27/02
(52) U.S. Cl. ..... 165/103; 165/153; 165/916
(58) Field of Search ..... 165/103, 153, 165/916, 47, 140

(56) References Cited

U.S. PATENT DOCUMENTS 4,443,188 * 4/1984 Buhler ..... 432/233
5,575,329 11/1996 So et al. .
5,797,450 * 8/1998 Kawabe et al. ..... 165/167
5,875,834 * 3/1999 Brooks ..... 165/11.1
5,906,237 * 5/1999 Aikawa ..... 165/153
5,950,715 * 9/1999 Jonsson et al. ..... 165/103

FOREIGN PATENT DOCUMENTS

564761 * 10/1993 (EP) ..... 165/916

* cited by examiner

*Primary Examiner*—Allen Flanigan
(74) *Attorney, Agent, or Firm*—Baker & Daniels

(57) ABSTRACT

A heat exchanger is disclosed having a plurality of stacked plate pairs or tubes, each having a predetermined internal cold flow resistance. A bypass conduit is included in the stack of plate pairs or tubes. The bypass conduit includes a central row of spaced-apart, mating dimples defining longitudinal flow channels on either side of the dimples for bypass flow through the bypass conduit under cold flow conditions. The longitudinal flow channels have a height and width such that the cold flow resistance therethrough is less than the cold flow resistance through the stacked plate pairs or tubes. In normal or hot flow conditions, the dimples create flow resistance by forcing the fluid flowing through the bypass conduit to change velocity and direction. This forces more oil to flow through the stacked plate pairs or tubes increasing heat transfer performance.

20 Claims, 5 Drawing Sheets

HEAT EXCHANGER WITH DIMPLED BYPASS CHANNEL

BACKGROUND OF THE INVENTION

This invention relates to heat exchangers, and in particular, to heat exchangers with built-in bypass channels to provide some flow through the heat exchanger under all operating conditions.

FIELD OF THE INVENTION

Where heat exchangers are used to cool oils, such as engine or transmission oils in automotive applications, the heat exchangers usually have to be connected into the flow circuit at all times, even where the ambient temperature is such that no oil cooling is required. Usually, the engine or transmission includes some type of pump to produce oil pressure for lubrication, and the pump or oil pressure produced thereby causes the oil to be circulated through the heat exchanger to be returned to a sump and the inlet of the pump. Under cold ambient conditions, the oil becomes very viscous, sometimes even like a gel, and under these conditions, the flow resistance through the heat exchanger is so great that little or no oil flows through the heat exchanger until the oil warms up. The result is that return flow to the transmission or engine is substantially reduced in cold conditions to the point where the transmission or engine can become starved of lubricating oil causing damage, or the oil inside the engine or transmission can become overheated before the heat exchanger becomes operational, in which case damage to the engine or transmission often ensues.

One way of overcoming these difficulties is to provide a pipe or tube that allows the flow to bypass the heat exchanger in cold flow conditions. Sometimes a bypass channel or conduit is incorporated right into the heat exchanger between the inlet and outlet of the heat exchanger. The bypass conduit has low flow resistance, even under cold ambient conditions, so that some bypass or short circuit flow can be established before any damage is done, as mentioned above. Usually these bypass channels are straight or plain tubes to minimize cold flow resistance therethrough, and while such bypass channels provide the necessary cold flow, they have a deleterious effect in that when the oil heats up and the viscosity drops, excessive flow passes through the bypass channels and the ability of the heat exchanger to dissipate heat is reduced. In order to compensate for this, the heat exchanger must be made much larger than would otherwise be the case. This is undesirable, because it increases costs, and often there is insufficient room available to fit a larger heat exchanger into an engine compartment or the like.

The present invention attempts to overcome these difficulties by providing a dimpled bypass channel in the heat exchanger, the dimples having a height, width and spacing to produce a desired cold flow resistance to permit cold flow, but also an increasing hot flow resistance as the temperature of the fluid in the bypass channel increases.

SUMMARY OF THE INVENTION

According to the invention, there is provided a heat exchanger comprising a plurality of stacked tubular members defining flow passages therethrough. The tubular members have raised peripheral end portions defining respective inlet and outlet openings, so that in the stacked tubular members, the respective inlet and outlet openings communicate to define inlet and outlet manifolds. The tubular members have a predetermined internal cold flow resistance. A bypass conduit is attached to the stacked tubular members. The bypass conduit has opposite end portions and a tubular intermediate wall extending therebetween defining a bypass channel. The opposite end portions of the bypass conduit define, respectively, a fluid inlet and a fluid outlet, the inlet and outlet communicating with the respective inlet and outlet manifolds for the flow of fluid through the bypass channel. The intermediate wall has a plurality of longitudinally spaced-apart, inwardly disposed, mating dimples formed therein. The mating dimples define flow restrictions between the mating dimples and adjacent areas of the intermediate wall. The mating dimples have a predetermined height and transverse width such that the cold flow resistance past the flow restrictions is less than the predetermined internal cold flow resistance of the tubular members. Also, the mating dimples are spaced apart such that the hot flow resistance pass the dimples increases as the temperature of the fluid in the bypass channel increases.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
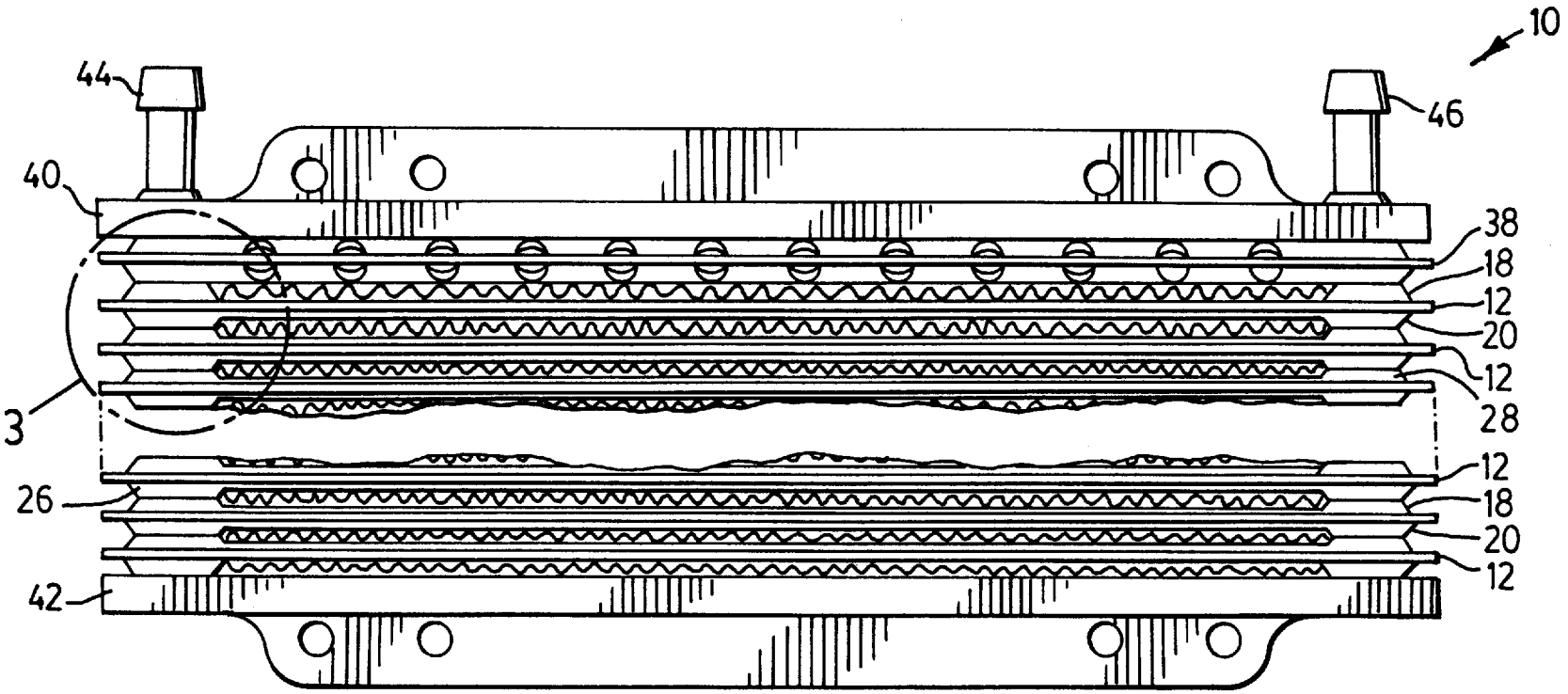
FIG. 1 is an elevational view of a preferred embodiment of a heat exchanger according to the present invention.
Figure 2:
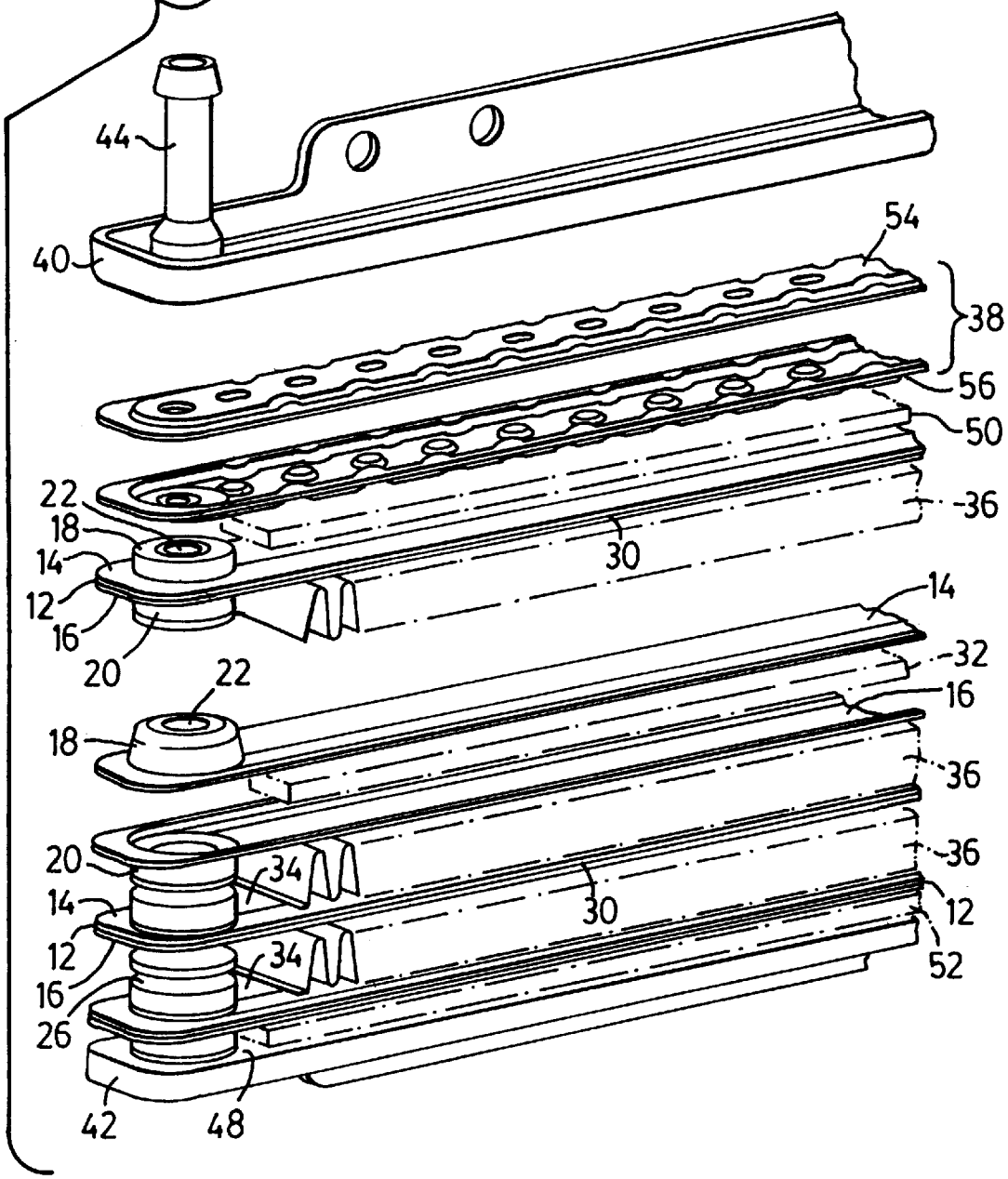
FIG. 2 is an enlarged, exploded, perspective view of the left side of the heat exchanger shown in FIG. 1.

Referring firstly to FIGS. 1 and 2, a preferred embodiment of a heat exchanger according to the present invention is generally indicated by reference numeral 10. Heat exchanger 10 is formed of a plurality of stacked tubular members 12 defining flow passages therethrough. Tubular members 12 are formed of upper and lower plates 14, 16 and thus may be referred to as plate pairs. Plates 14, 16 have raised peripheral end portions 18, 20. End portions 18, 20 have respective inlet or outlet openings 22 (see FIG. 3), so that in the stacked tubular members 12, inlet/outlet openings 22 communicate to define inlet and outlet manifolds 26, 28. Tubular members 12 also have central tubular portions 30 extending between and in communication with inlet and outlet manifolds 26, 28. Inlet and outlet manifolds 26, 28 are interchangeable, so that either one could be the inlet, the other being the outlet. In any case, fluid flows from one of the manifolds 26 or 28 through the central portions 30 of tubular members 12 to the other of the manifolds 26, 28.

The central portions 30 of tubular members 12 preferably have turbulators or turbulizers 32 located therein. Turbulizers 32 are formed of expanded metal or other material to produce undulating flow passages to increase the heat transfer ability of tubular members 12. Turbulizers 32 and the internal dimensions of the plate central portions 30 cause tubular members 12 to have a predetermined internal cold flow resistance, which is the resistance to fluid flow through tubular members 12 when the fluid is cold. Heat exchanger 10 is typically used to cool engine or transmission oil, which is very viscous when it is cold. As the oil heats up, its viscosity drops and normal flow occurs through tubular members 12.

Figure 3:
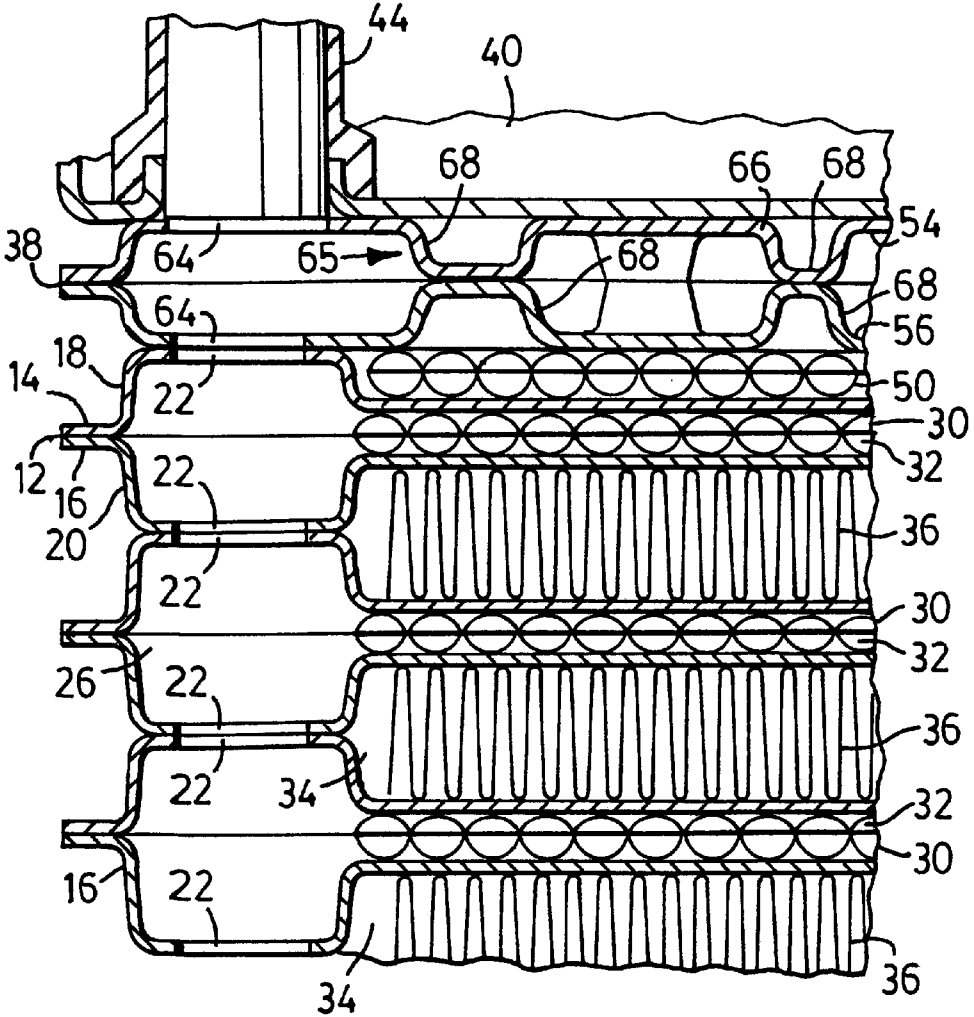
FIG. 3 is an enlarged vertical sectional view of the portion of FIG. 1 indicated by the chain-dotted circle 3.
Figure 4:
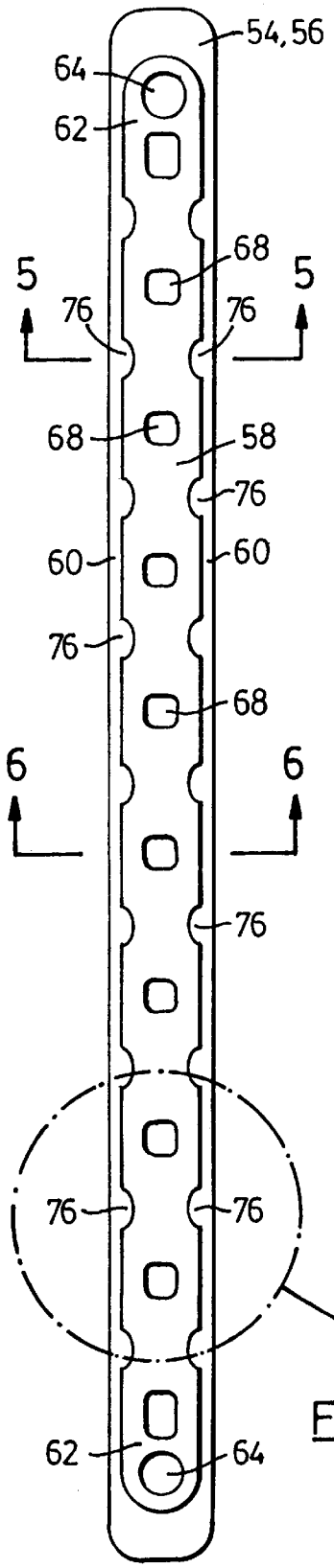
FIG. 4 is a plan view of one of the plates used to make the bypass channel of the heat exchanger of FIG. 1.
Figure 5:
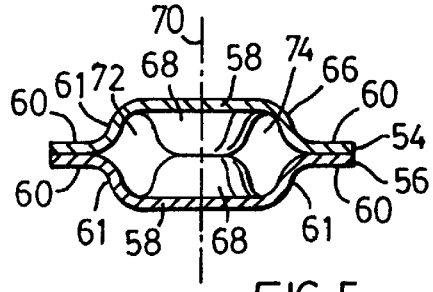
FIG. 5 is a vertical sectional view taken along lines 5—5 of FIG. 4.
Figure 6:
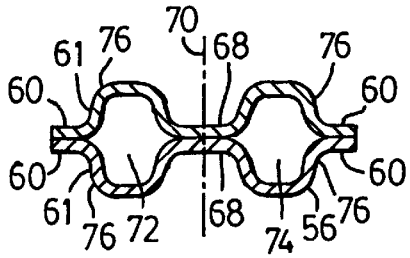
FIG. 6 is a vertical sectional view taken along lines 6—6 of FIG. 4.

As seen best in FIGS. 2 and 3, the raised end portions 18, 20 of plates 14, 16 cause the central portions 30 of tubular members 12 to be spaced apart to define transverse external flow passages 34 between the tubular members. Corrugated cooling fins 36 are located in external flow passages 34. Normally air passes through cooling fins 36, so heat exchanger 10 may be referred to as an oil to air type heat exchanger.

Heat exchanger 10 also includes a dimpled bypass channel 38, and top and bottom end plates or mounting plates 40, 42. Top mounting plate 40 includes inlet and outlet fittings or nipples 44, 46 for the flow of fluid into and out of inlet and outlet manifolds 26, 28. Bottom mounting plate 42 has a flat central planar portion 48 that closes off the inlet/outlet openings 22 in the bottom plate 16 of bottom tubular member 12.

As seen best in FIGS. 2 and 3, a half-height cooling fin 50 is located between bypass channel 38 and the top tubular member 12. Another half-height cooling fin 52 is located between the bottom tubular member 12 and bottom mounting plate 42. Preferably, half-height fins 50, 52 are formed of the same material used to make turbulizers 32 to reduce the number of different components used to make heat exchanger 10. However, cooling fins 50,52 can be made in other configurations as well, such as the same configuration as cooling fins 36, but of reduced height.

As mentioned above, tubular members 12 are formed of face-to-face plates 14, 16 and may thus be referred to as plate pairs. Plates 14, 16 are identical. Instead of using turbulizers 32 between the central portions 30 of these plate pairs 12, the central portions 30 could have inwardly disposed mating dimples to create the necessary flow turbulence inside the tubular members. Further, tubular members 12 do not need to be made from plate pairs. They could be made from tubes with appropriately expanded end portions to define manifolds 26, 28. Also, cooling fins 36, 50 and 52 could be eliminated if desired. In this case, outwardly disposed dimples could be formed in the tubular member central portions 30 to provide any necessary strengthening or turbulence for the transverse flow of air or other fluid between tubular members 12. It will be apparent also that other types of mounting plates 40, 42 can be used in heat exchanger 10. The stacked tubular members 12 may be referred to as a core. The core can be any width or height desired, but usually, it is preferable to have the core size as small as possible to achieve a required heat transfer capability.

Referring next to FIGS. 4 to 8, bypass channel or conduit 38 will now be described in detail. Bypass conduit 38 is formed of two face-to-face, identical plates 54, 56, each having a central planar portion 58 and raised peripheral flanges 60. Peripheral side walls 61 join central planar portion 58 to flanges 60. Bypass conduit 38, or at least plates 54, 56, have opposite end portions 62 that define inlet/outlet openings 64. Central portions 58 and peripheral side walls 61 form a tubular intermediate wall extending between opposite end portions 62 to define a bypass channel 65 extending between the respective inlet/outlet openings 64.

As seen best in FIG. 3, the inlet/outlet openings 64 of bypass conduit 38 communicate with the respective inlet and outlet manifolds 26, 28 and the inlet and outlet fittings 44, 46. So, for example, flow entering fitting 44 will pass into manifold 26 to pass through tubular members 12, but part of the flow will pass through the bypass channel 65 defined by the tubular intermediate wall 66.

The central planar portions 58 of intermediate wall 66 are formed with a plurality of longitudinally spaced-apart, inwardly disposed, mating dimples 68. Dimples 68 define flow restrictions between dimples 68 and the adjacent peripheral side wall areas 61 of intermediate wall 66. Dimples 68 extend inwardly and are located in a longitudinal central plane 70 to define longitudinal flow passages 72, 74 (see FIG. 8) on either side of the mating dimples 68.

Figure 8:
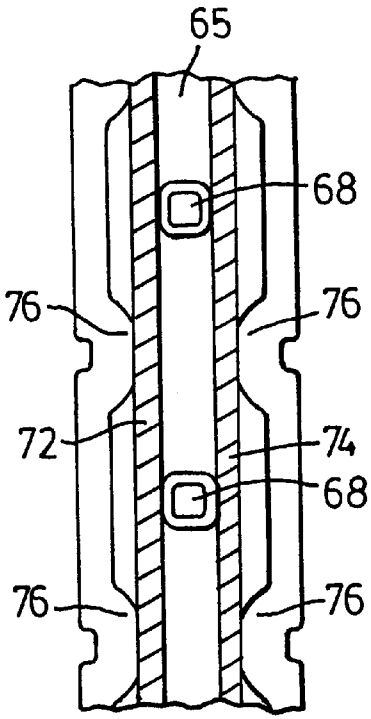
FIG. 8 is an enlarged view of the portion of FIG. 4 indicated by chain-dotted circle 8.
Figure 7:
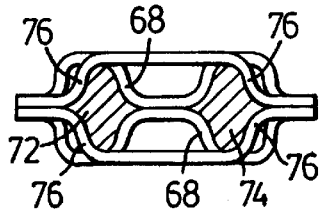
FIG. 7 is a vertical sectional view showing FIG. 5 superimposed on top of FIG. 6.

Intermediate wall 66 also includes a plurality of peripheral, inwardly disposed dimples 76 located longitudinally between mating dimples 68 and extending part way into bypass channel 65, or at least longitudinal flow passages 72, 74, as seen best in FIGS. 7 and 8.

Referring in particular to FIG. 7, it will be noted that the cross-sectional shape of longitudinal flow passages 72, 74, as represented by the crosshatched areas, is sort of diamond shaped at the location of peripheral dimples 76. This crosshatched area represents the minimum cross sectional area of the bypass flow that flows along the length of bypass channel 65. This is the shape of the bypass flow in cold flow conditions. The height of longitudinal flow passages 72, 74 is predetermined. It is equal to twice the height of dimples 68 and is greater than the height of the flow passages inside tubular members 12 that contain turbulizers 32. The width of longitudinal flow passages 72, 74 must be considered from the point of view of an average or effective width in view of its irregular shape. This average or effective width is also predetermined and is preferably less than the height of longitudinal flow passages 72, 74. In fact, the average width of longitudinal flow passages 72, 74 is preferably one half or less of the height of these flow passages.

In a preferred embodiment of heat exchanger 10, where the plates that make up bypass conduit 38 and tubular members 12 are formed of brazing clad aluminum having a width of 19 mm (0.75 inches) and a material thickness of 0.71 mm (0.028 inches), the predetermined height of longitudinal flow passages 72, 74 is 5.6 mm (0.22 inches) and the predetermined average width of these flow passages is generally about 2.3 mm (0.09 inches). The longitudinal spacing or pitch of dimples 68 is about 3.2 centimeters (0.820 inches). Dimples 68 are as nearly square as possible within given metal deformation limits. The base of these dimples in the example under discussion would be about 7 mm (0.27 inches) square and the crests would be about 4 mm (0.16 inches) square.

The height of longitudinal flow passages 72, 74 is equal to the height of the combined mating dimples 68, and the effective width of these flow passages is equal to or less than the average transverse distance between mating dimples 68 and peripheral dimples 76. While it is preferred to have the height of longitudinal flow passages 72, 74 at least twice the effective width of these longitudinal flow passages, there are limits as to how high the aspect ratio of these longitudinal flow passages can be because of the metal formation limits that exist when forming plates 54, 56.

Under cold flow conditions, the bypass flow through bypass channel 65 would be as indicated in FIG. 7 and 8. The predetermined height and transverse width of longitudinal flow passages 72, 74 are such that the cold flow resistance past the flow restrictions imposed by dimples 68 and 76 is less than the cold flow resistance inside tubular members 12. As the fluid inside bypass conduit 38 heats up, however, the dimples 68 and 76 cause turbulent flow or changes in flow velocity and direction inside conduit 38 and actually higher flow resistance than what would occur if bypass channel 65 were just a straight through passage.

It will be appreciated that by changing the dimensions of longitudinal flow passages 72,74, such as by changing the dimensions of dimples 68 and 76, the pressure drop of the whole heat exchanger 10 can be adjusted or tuned to suit a desired application.

As mentioned above, tubular members 12 can be formed of dimpled plates instead of using turbulizers 32. In this case, the height of the dimples in tubular members 12 preferably would be less than the height of the dimples in bypass conduit 38, so that the cold flow resistance in bypass conduit 38 is less than the cold flow resistance in tubular members 12. Alternatively, the number and the spacing of the dimples in tubular members 12 could be chosen to give higher cold flow resistance in tubular members 12 than is bypass conduit 38.

Figure 9:
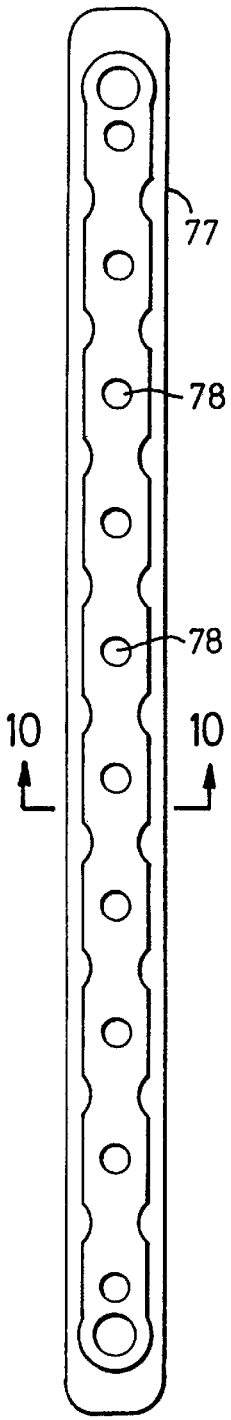
FIG. 9 is a plan view of another embodiment of a plate used to make a bypass channel for a heat exchanger according to the present invention.
Figure 11:
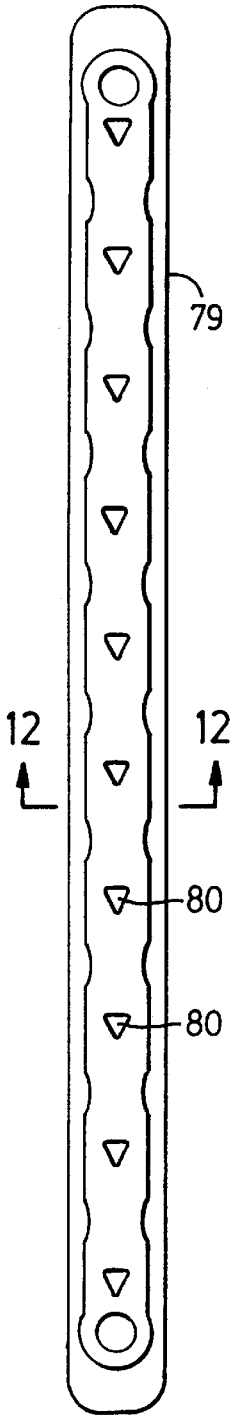
FIG. 11 is a plan view of another embodiment of a plate used to make a bypass channel for a heat exchanger according to the present invention.
Figure 13:
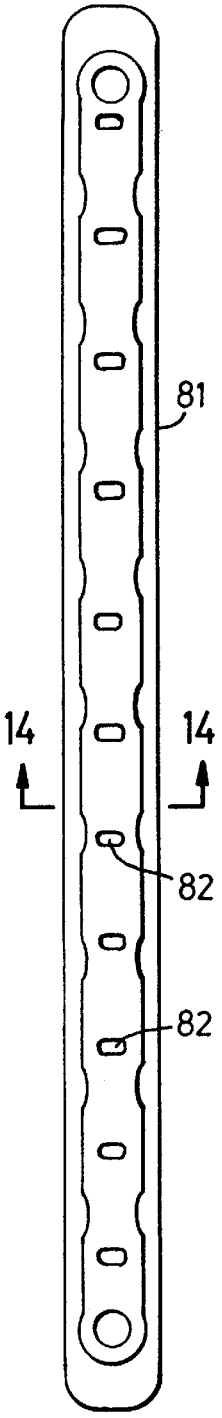
FIG. 13 is a plan view of yet another embodiment of a plate used to make a bypass channel for a heat exchanger according to the present invention.
Figure 10:
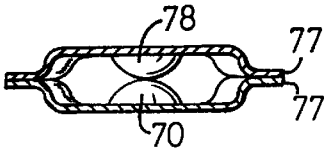
FIG. 10 is a vertical sectional view taken along lines 10—10 of FIG. 9.
Figure 12:
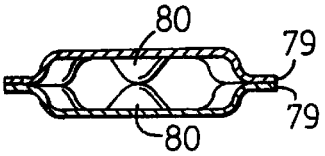
FIG. 12 is a vertical sectional view taken along lines 12—12 of FIG. 11.
Figure 14:
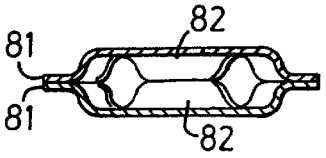
FIG. 14 is a vertical sectional view taken along lines 14—14 of FIG. 13.

Although dimples 68 shown in FIGS. 1 to 8 preferably are as square as possible to maximize the hot flow turbulence inside bypass conduit 38, the dimples can be other shapes, as illustrated in FIGS. 9 to 14. FIGS. 9 and 10 show a bypass plate 77 having hemispherical dimples 78. Dimples 78 thus are circular in plan view. FIGS. 11 and 12 show a bypass plate 79 having pyramidal dimples 80 that are triangular in plan view. FIGS. 13 and 14 show a bypass plate 81 having rectangular dimples 82 having the long side of the rectangles in the transverse direction and the short side of the rectangles in the longitudinal direction, but dimples 82 could be orientated differently, such as on an angle, if desired. In fact, such elongate dimples 82 could be considered to be more like ribs than dimples. In the embodiment of FIGS. 13 and 14, the width of bypass plate 81 is about 32 mm (1.26 inches). However, the dimensions of longitudinal flow passages 72,74 preferably are about the same as in the embodiment shown in FIGS. 1 to 8, all other dimensions (except the width of ribs or dimples 82) being about the same as the embodiment shown in FIGS. 1 to 8 as well.

Having described preferred embodiments of the invention, it will be appreciated that various modifications may be made to the structures described above. For example, in heat exchanger 10, bypass conduit 38 is shown at the top adjacent to top mounting plate 40. However, bypass conduit 38 could be located anywhere in the core or stack of plate pairs. Bypass conduit 38 has been described as being generally rectangular in cross section. However, it could have other configurations such as circular. Mating dimples 68, 78, 80 and 82 could also be located in a horizontal plane rather than a vertical plane. The peripheral dimples would then be located in a plane that is 90 degrees to the plane containing the central mating dimples.

It will also be appreciated that the heat exchanger of the present invention can be used in applications other than automotive oil cooling. The heat exchanger of the present invention can be used in any application where some cold flow bypass flow is desired.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A heat exchanger comprising: a plurality of stacked tubular members defining flow passages therethrough, the tubular members having raised end portions defining respective inlet and outlet openings, so that in the stacked tubular members, the respective inlet and outlet openings communicate to define inlet and outlet manifolds, said tubular members having a predetermined internal cold flow resistance; a bypass conduit attached to the stacked tubular members, the bypass conduit having opposite end portions and a tubular intermediate wall extending therebetween defining a bypass channel, the opposite end portions of the bypass conduit defining, respectively, a fluid inlet and a fluid outlet, said inlet and outlet communicating with the respective inlet and outlet manifolds for the flow of fluid through the bypass channel; said intermediate wall having a plurality of longitudinally spaced-apart, inwardly disposed, mating dimples formed therein, the mating dimples defining flow restrictions between the mating dimples and adjacent areas of said intermediate wall; the mating dimples having a predetermined height and transverse width such that the cold flow resistance past said flow restrictions is less than said predetermined internal cold flow resistance of the tubular members; and the mating dimples being spaced-apart such that the hot flow resistance past the dimples increases as the temperature of the fluid in the bypass channel increases.

2. A heat exchanger as claimed in claim 1 and further comprising turbulizers located in the stacked tubular member flow passages.

3. A heat exchanger as claimed in claim 2 wherein said turbulizers are formed of expanded metal.

4. A heat exchanger as claimed in claim 1 wherein said intermediate wall further includes a plurality of peripheral, inwardly disposed dimples located between the mating dimples, said peripheral dimples extending part way into the bypass channel.

5. A heat exchanger as claimed in claim 4 wherein the mating dimples extend inwardly in a central plane, and wherein the peripheral dimples extend inwardly toward said central plane to define longitudinal flow channels between the mating dimples and the peripheral dimples.

6. A heat exchanger as claimed in claim 1 wherein the bypass channel has a height and the mating dimples have a height that is one-half the height of the bypass channel, and wherein the stacked tubular member flow passages have a height, the height of the bypass channel being greater than the height of the tubular member flow passages.

7. A heat exchanger as claimed in claim 1 wherein the bypass conduit has a longitudinal central plane, the mating dimples being located in the longitudinal central plane to define longitudinal flow passages on either side of the mating dimples.

8. A heat exchanger as claimed in claim 7 wherein the longitudinal flow passages have a predetermined height and a predetermined average width, said height being equal to the sum of the heights of the mating dimples and the average width being less than the predetermined height.

9. A heat exchanger as claimed in claim 8 wherein said average width is one-half said predetermined height.

10. A heat exchanger as claimed in claim 8 wherein the predetermined height is generally 5.6 mm (0.22 inches) and the predetermined average width is generally 2.3 mm (0.09 inches).

11. A heat exchanger as claimed in claim 1 wherein the stacked tubular members are formed with a plurality of spaced apart, inwardly disposed mating dimples, said dimples having a height that is less than the height of the dimples formed in said bypass conduit intermediate wall.

12. A heat exchanger as claimed in claim 3 wherein the tubular member raised end portions define transverse external flow passages between the tubular members, and further comprising corrugated fins located in said transverse passages.

13. A heat exchanger as claimed in claim 5 wherein the longitudinal flow channels have a height equal to the height of the mating dimples and an effective width equal to the average transverse distance between the mating dimples and the peripheral dimples.

14. A heat exchanger as claimed in claim 13 wherein the height of the longitudinal flow passages is at least twice the effective width of the longitudinal flow passages.

15. A heat exchanger as claimed in claim 14 wherein the mating dimples are rectangular in plan view.

16. A heat exchanger as claimed in claim 14 wherein the mating dimples are circular in plan view.

17. A heat exchanger as claimed in claim 14 wherein the mating dimples are pyramidal.

18. A heat exchanger as claimed in claim 9 wherein the mating dimples are rectangular in plan view.

19. A heat exchanger as claimed in claim 12 wherein the mating dimples are rectangular in plan view.

20. A heat exchanger as claimed in claim 9 wherein the mating dimples are circular in plan view.

* * * * *